US005320509A

United States Patent [19]

Oka

[11] Patent Number: 5,320,509

[45] Date of Patent: Jun. 14, 1994

[54] MOLTEN METAL-ATOMIZING APPARATUS

[75] Inventor: Teruyasu Oka, Yasugi, Japan

[73] Assignee: Hitachi Metals, Ltd., Tokyo, Japan

[21] Appl. No.: 953,954

[22] Filed: Sep. 29, 1992

[30] Foreign Application Priority Data

Oct. 1, 1991 [JP] Japan ..... 3-253552
Apr. 1, 1992 [JP] Japan ..... 4-079527

[51] Int. Cl.[5] ..... B22F 9/08

[52] U.S. Cl. ..... 425/7; 75/337; 75/338; 264/11; 264/12

[58] Field of Search ..... 425/6, 7; 264/11, 12, 264/DIG. 75; 75/338, 339, 335, 337; 65/5, 16

[56] References Cited

U.S. PATENT DOCUMENTS 3,592,391 7/1971 Bender ..... 425/7
3,663,206 5/1972 Lubanska ..... 75/338
3,695,795 10/1972 Jossick ..... 75/338

FOREIGN PATENT DOCUMENTS 3839739 10/1989 Fed. Rep. of Germany ..... 425/7
1-259107 10/1989 Japan ..... 435/7
2-243705 9/1990 Japan ..... 425/7
2-294413 12/1990 Japan ..... 75/338
426439 6/1967 Switzerland ..... 425/7

*Primary Examiner*—Jay H. Woo
*Assistant Examiner*—Joseph Leyson
*Attorney, Agent, or Firm*—Antonelli, Terry, Stout & Kraus

[57] ABSTRACT

There is disclosed a molten metal-atomizing apparatus which prevents the formation of a blocking in an ultra-high pressure atomizing of molten metal, and can produce finer metal powder. A vertical distance from the position of occurrence of a primary atomizing effect to a lower end of a jet injection port of a nozzle is 40% to 85% of a vertical distance from the lower end of the injection port to the position of intersection of jets.

1 Claim, 2 Drawing Sheets

MOLTEN METAL-ATOMIZING APPARATUS

BACKGROUND OF THE INVENTION

This invention relates to an apparatus for producing metal powder, in which molten metal is formed into metal powder by a fluid atomizing method.

In the production of high alloy powder among metal powders used in the powder metallurgy field, an atomizing method is proposed, with such method being broadly classified into a liquid atomizing method using a liquid, composed mainly of water, as an atomizing medium and a gas atomizing method using inert gas as an atomizing medium. With this method, a large amount of metal powder having the average particle size of several μm to several tens of μm can be produced.

However, in order to consistently produce fine powder, it has been desired to provide technical improvements in the atomizing apparatus and the atomizing condition.

One problem which must be solved in order to consistently produce fine powder is a blocking phenomenon. Various causes for this phenomenon have been studied, and main causes with respect to an atomizing apparatus of the general type shown in FIG. 4 will now be described. Referring to one main cause, downwardly-inclined high-speed jets J are arranged to intersect each other, and are disposed symmetrically with respect to a vertical line. When molten metal M is caused to flow in a downward direction (as designated at M') toward the intersection point P2, part of the molten metal M is blown up near the intersection point (atomizing point) P2 by the high-speed jet J impinging on this molten metal M, so that part of the downward flow M' deposits on an inner surface 4 of an injection nozzle 3 to form a blockage. This tendency is apparent particularly with the gas atomizing method.

Another cause of the blocking phenomenon is an atomizing phenomenon due to a flow of the atmosphere. During the downward flow of the molten metal M to the atomizing point P2 where the molten metal M is crushed and cooled by the high-speed jet J, part of the downward flow M' is primarily atomized into molten metal fractions under the influence of the atmosphere flow, blown into the high-speed jet, or a negative pressure. Namely, this primarily-atomized fraction deposits on the inner surface 4 of the nozzle 3 to form a blockage. This tendency is apparent particularly with the liquid atomizing method.

The columnar molten metal flow M', before being crushed by the high-speed jet J, is divided by the above-mentioned primary atomizing effect, and then is vigorously crushed by the atomizing effect of the high-speed jet, and is cooled into metal powder. In the present invention, the initial division of the molten metal is referred to as "primary atomization", and the point at which this primary atomization occurs is referred to as "primary atomizing point", and the crush at the intersection point of the high-speed jet is referred to as "secondary atomization".

The above blocking phenomenon finally makes it impossible to continue the atomization. To overcome this, various proposals have been made and, for example, Japanese Patent Unexamined Publication No. 57-47805 discloses a method in which gas, introduced by an inducing effect of a high-speed water jet, is maintained by a flow straightener into a laminar flow along a downward flow of molten metal, thereby suppressing a primary atomizing effect to prevent the blockage.

In order to meet recent demands for a particle size of fine powder not to exceed 10 μm, in view of sintering properties and so on, in the water atomizing method, an ultra-high pressure atomizing technique utilizing a high-speed jet with an injection pressure of about 100 MPa has now been mainly used.

With respect to the production technique disclosed in the above Japanese Patent Unexamined Publication No. 57-47805, in an ultra-high pressure atomizing method using a pressure of more than 70 MPa, it has been found that the negative pressure atmosphere due to the water jet is excessive, so that it becomes difficult to maintain the laminar flow along the downward flow of the molten metal, and therefore the blocking occurs.

In conventional fluid atomizing methods other than that disclosed in the above Japanese Publication, a negative pressure atmosphere produced by an ultra-high pressure jet is excessive, it is necessary to prevent a blocking which is caused by the deposition of primarily-atomized fractions on a surface of an injection nozzle.

Further, in order to produce a large amount of fine powder having the average particle size not exceeding 10 μm, it has been proposed to adopt an ultra-high pressure atomizing method utilizing an injection jet pressure of 100 MPa or more, as described above. This serves to increase the kinetic energy of the high-speed jet to be injected, but results in a disadvantageous blocking phenomenon caused by the ultra-high pressure jet injection, as described above.

SUMMARY OF THE INVENTION

It is an object of this invention to provide an atomizing apparatus which prevents the formation of a blocking in a ultra-high pressure atomizing method, and produces fine powder more efficiently.

According to the present invention, there is provided a molten metal-atomizing apparatus wherein downwardly-inclined high-speed jets are arranged to intersect each other, and are disposed symmetrically with respect to a vertical line. Molten metal is caused to flow downwardly toward the intersecting point so as to produce a metal powder. A vertical distance from a lower end of a jet injection port of a nozzle, which injects the high-speed jet, to a primary atomizing point is 40% to 85% of a vertical distance from the lower end of the jet injection port to the jet intersecting point.

In accordance with further features of the invention, there is provided a molten metal-atomizing apparatus wherein downwardly-inclined high-speed jets are arranged to intersect each other, and are disposed symmetrically with respect to a vertical line. Molten metal is caused to flow downwardly toward the intersecting point so as to produce metal powder. Straight portions, whose extension lines intersect each other generally on the vertical line in a cross-sectional plane including the vertical line, are formed on an inner surface extending from an upper end of a nozzle, which injects the jet, to an injection port. A vertical distance from a lower end of the injection port to a point of intersection between the extension lines is 40% to 85% of a vertical distance from the lower end of the jet injection port to the jet intersecting point.

According to the invention, there is provided a molten metal-atomizing apparatus wherein downwardly-inclined high-speed jets are arranged to intersect each other, and are disposed symmetrically with respect to a vertical line, with molten metal being caused to flow downwardly toward the intersecting point so as to produce metal powder. An intersection angle of the high-speed jets is in the range of 25° to 50°. When, a cross-sectional plane including the vertical line, there is drawn a straight line which is parallel to the high-speed jet, and is either tangential to a contour line of an inner surface of a nozzle extending from an upper surface of the nozzle to an injection port, or is passing through only one point on the contour line, a vertical distance from a lower end of the injection port to a point of intersection of the straight line and the vertical line is 40% to 85% of a vertical distance from the lower end of the jet injection port to the jet intersecting point.

DESCRIPTION OF THE INVENTION

Figure 1:
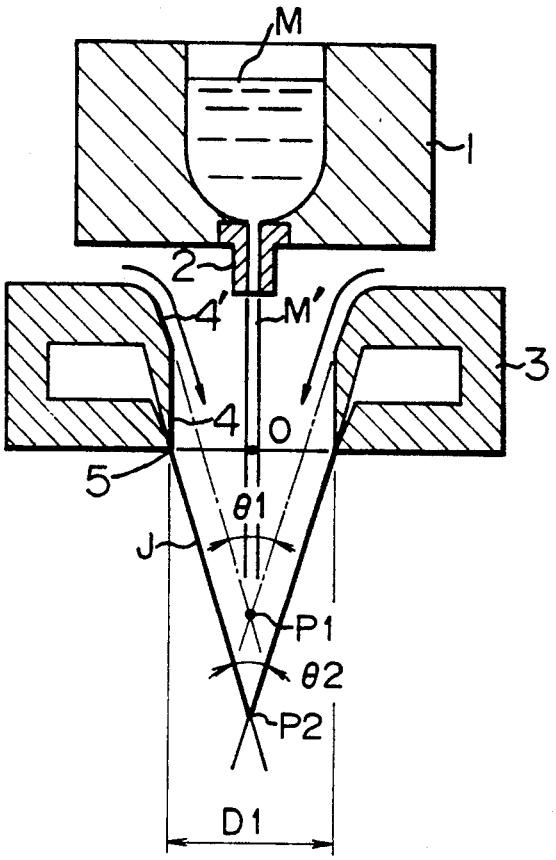
FIG. 1 is a cross-sectional view of a molten metal atomizing apparatus of the present invention, showing an injection nozzle and adjacent portion.

In an atomizing apparatus according to the present invention, a primary atomizing effect is made harmless with respect to the formation of a blockage, and is also used positively for obtaining fine powder. More specifically, in the apparatus according to a first embodiment of the present invention, a vertical distance from a lower end of a jet injection port of a nozzle to a position Pl where the primary atomizing, hereinafter referred to as a primary atomizing point ratio, occurs is 40% to 85% of a vertical distance from the lower end of the jet injection port to an intersection point P2 of the jet. With a small primary atomizing point ratio, the primary atomizing effect occurs at a relatively upper position, whereby a fraction of the molten metal produced at this position reaches the inner surface of the nozzle, and is liable to deposit thereon to solidify to form a blockage; however, it has been determined that by virtue of the present invention, by controlling this ratio, so as to be not less than 40%, the formation of the blockage can be substantially prevented.

If this primary atomizing point ratio is small, the primary atomizing effect occurs at a relative upper position, as described above, and it takes a relatively long time for the fraction, produced at this position, to reach a secondary atomizing point P2 where the injection jet intersects to produce a strong atomizing effect, and during this time period, this fraction is cooled and solidified, thereby lowering the yield rate of the fine powder.

In order to efficiently produce the fine powder, it is necessary to supply a large amount of finely divided fractions of the molten metal, maintained at elevated temperatures, from the primary atomizing point to the secondary atomizing point P2. By doing so, these divided fractions of the molten metal are further crushed more finely by the high-speed jet, and are cooled to form fine metal powder. If the primary atomizing point ratio is not less than 40%, the primarily-atomized divisional fraction of the molten metal will not deposit on the spray nozzle, but is attracted toward the intersection point of the high-speed jet, and is secondarily atomized into fine metal powder. Therefore, by eliminating the deposition of the divisional fraction of the molten metal, the blocking phenomenon is prevented from occurring. The closer the intersecting point of the atmosphere gas flow, that is, the primary atomizing point P1, is to the secondary atomizing point P2, though to a certain point, the greater its effect is, because the greatest negative pressure is present in the vicinity of the intersecting point of the high-speed jet, and therefore the primary atomizing effect occurs effectively, so that the finely divided fractions of the molten metal are produced in a large amount. And besides, since the distance from the primary atomizing point to the secondary atomizing point is short, the cooling of the divisional fraction is maintained to a minimum, and at the secondary atomizing point P2, this fraction, while maintained at relatively high temperatures, is secondarily atomized to form the fine metal powder.

On the other hand, if the primary atomizing point ratio exceeds 85%, the divisional fraction due to the primary atomizing effect, before provided in a sufficiently large amount, reaches the secondary atomizing point, so that the yield rate of the fine powder is reduced.

Generally, it is difficult to directly measure the primary atomizing point ratio, that is, the position of the primary atomizing point, even by the use of a special fiber scope. Therefore, in the design of the atomizing apparatus, and particularly the nozzle, it is important that the primary atomization should occur as near to a desired or predetermined position as possible.

Figure 4:
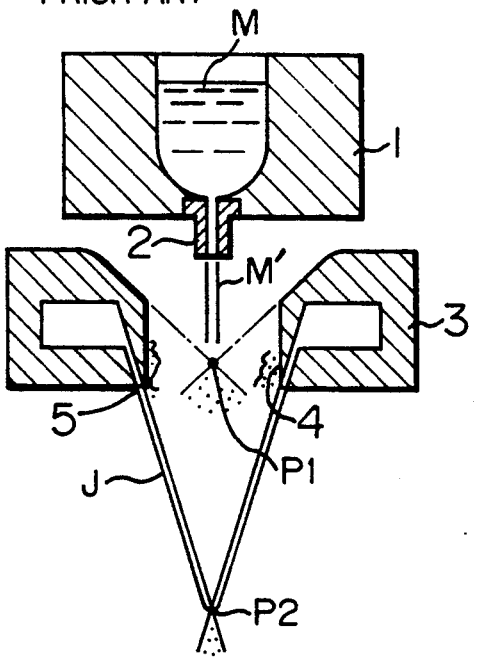
FIG. 4 PRIOR ART
FIG. 4 is a schematic cross-sectional view of a conventional atomizing apparatus.

As apparent from FIG. 4, wherein a nozzle has an annular shape to surround a downward flow of molten metal, it has been found that when a downwardly-tapering conical surface is formed on part of the inner peripheral surface of the nozzle extending from its upper surface to its injection port, the primary atomizing effect occurs generally at the apex of this cone. Similarly, when a nozzle has opposed portions between which a downward flow of molten metal is interposed, it has been found that when straight surfaces, defining a V-shape, are formed respectively on portions of the opposed surfaces of the nozzle extending from its upper surface to its injection port, the primary atomizing effect occurs generally at the intersection (which defines the bottom of the above V-shape) between these two straight surfaces.

In the vicinity of an injection nozzle of an atomizing apparatus shown in FIG. 1, molten metal M flows downwardly as a column of molten metal flow M' of a small diameter from a molten metal nozzle 2 provided at a bottom of a tundish 1, and a high-speed jet J is injected from an injection nozzle 3 to the columnar molten metal flow M' to form the molten metal M into fine powder. In this case, the injection nozzle has an annular shape to surround the columnar molten metal flow M', and a conical surface 4' is formed on part of an inner peripheral surface 4 of the injection nozzle extending from its upper surface to its injection port. With this construction, the primary atomizing effect occurs in the vicinity of the apex of the above cone. In the present invention, the vertical distance from this primary atomizing point Pl to the lower end of the jet injection port 5 of the nozzle 3 is 40% to 85% of the vertical distance from the lower end of the injection port 5 to an intersecting point or secondary atomizing point P2 of the high-speed jet.

The atmosphere gas flow, produced by the suction effect of the high-speed jet, is low in speed at its upper side, and the degree of negative pressure of this atmosphere gas flow, as well as its velocity, increases progressively toward its lower side. While its flow velocity is maintained at a relatively low level, this atmosphere gas flows along the inner peripheral surface 4 from the upper surface of the spray nozzle to the injection port. However, the gas flow, sufficiently increased in speed, becomes straightened, and gets out of restraint of the inner surface 4, and in some cases may be separated from the inner surface 4, and it is thought that this flow converges into a relatively narrow space, and that the primary atomizing effect occurs in this space.

If the conical surface is wide, there is a high possibility that, within the range of this width, the atmosphere flow reaches such a flow velocity that it separates from the inner surface. Therefore, the primary atomizing point can be predicted with a higher probability, and this is advantageous.

Even if a conical surface, in a strict sense of a word, is not provided on the inner peripheral surface extending from the upper surface of the nozzle to the injection port, an approximate position of the primary atomizing point can be estimated from a conical surface approximate to the above conical surface if such an approximate conical surface can be estimated. Therefore, this case belongs to the category of the second invention.

Although the above description is directed to the annular nozzle, the effects are quite the same with a so-called V-shaped nozzle having opposed portions between which the downward flow of the molten metal is interposed.

It is difficult to estimate the primary atomizing point from the concept of the second invention if the radius of curvature of the inner peripheral surface extending from the upper surface of the nozzle to the injection port either has a finite constant value, or is continuously varying generally uniformly.

In this case, when the intersection angle of the high-speed jet is in the range of 25° to 50°, and when in a cross-sectional plane including the vertical centerline of the nozzle, there is drawn a straight line which is parallel to the high-speed jet, and is either tangential to a contour line of the inner peripheral surface of the nozzle extending from the upper surface of the nozzle to the injection port, or passes through only one point on this contour line, it has been found that the primary atomizing effect occurs generally at a point where this straight line intersects the above vertical centerline. The reason for this has not yet been determined, but it is thought that this is related to the fact that the condition of separation of the atmosphere flow from the inner peripheral surface extending from the upper surface of the nozzle is greatly influenced not only by the flow velocity at that time but also by the radius of curvature of the inner peripheral surface in the direction of the above flow velocity. In the present invention, the straight line passing through only one point on the contour line means a straight line which when the contour line is not a curved line such as an arcuate line but is bent inwardly convexly, passes only through a point of bending of the contour line.

EXAMPLE 1

Nozzles having specifications shown in FIG. 1 and Table 1 were prepared, and atomizing tests of these nozzles were conducted with injection pressures shown in Table 1.

With respect to the pouring of molten metal, molten steel equivalent to JIS SKH10 a high speed tool steel containing a high content of vanadium, was poured from a melting furnace to the tundish 1, and the molten metal was supplied from the molten metal nozzle 2 by gravity-drop as a columnar molten metal flow having a diameter of 4 mm. The injection pressure was 49 to 105 MPa. Results of the production of the metal powder by the apparatus of the present invention and the apparatus of the prior art are shown in Table 1.

TABLE 1

| | Apex angle of cone $\theta_1$ (degree) | Intersection angle of jet $\theta_2$ (degree) | Diameter of jet $D_1$ ($\phi$ mm) | $OP_1/OP_2$* (%) | Injection pressure (MPa) | Atomizing condition | −44 μm average particle size (μm) |
|---|---|---|---|---|---|---|---|
| Methods of Invention | | | | | | | |
| 1 | 40 | 30 | 40 | 42 | 68.6 | good | 7.2 |
| 2 | 45 | 40 | 50 | 63 | 60 | " | 8.7 |
| 3 | 40 | 50 | 38 | 77 | 78.4 | " | 6.4 |
| 4 | 40 | 40 | 38 | 83 | 105 | " | 5.2 |
| Conventional methods | | | | | | | |
| 1 | 50 | 30 | 40 | 12 | 49 | " | 17.8 |
| 2 | 60 | 40 | 38 | 22 | 73.5 | blocking | 12.8 |
| 3 | 55 | 50 | 38 | 38 | 93.1 | " | 10.5 |

The average particle size of the produced powder in Table 1 is the average particle size of the powder passed through a screen having a nominal size of 44 μm.

In the conventional method No. 1, the primary atomizing point ratio was 12%, and the injection pressure was 49 MPa, and no blockage was formed, and the atomizing condition was good. However, the average particle size (−44 μm) of the produced powder was coarse, that is, on the order of 17.8 μm. In the conventional method Nos. 2 and 3, the atomizing point ratios thereof were 22% and 38%, respectively, and when the injection pressure was high, a blockage was formed, and a proper atomizing was not effected, and the average particle sizes (−44 μm) of the produced powders were not fine enough, that is, on the order of 12.8 μm and 10.5 μm, respectively.

In the method Nos. 1 to 4 of the present invention, the primary atomizing point ratio was 42 to 83%, and even when the injection pressure was ultra-high (105 MPa), no blockage was formed, and, as compared with the conventional method, it will be appreciated that the powder becomes finer with the increase of the pressure.

EXAMPLE 2

Figure 2:
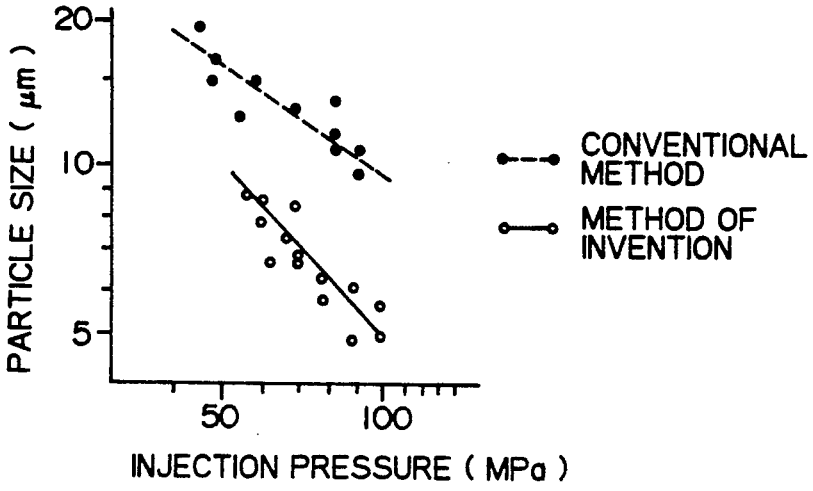
FIG. 2 is a graphical illustration of a relationship between an injection pressure and the average particle size of powder obtained by the present invention.

Using the nozzles of the method No. 4 of the invention and the conventional method No. 2 in Example 1, an atomizing test was conducted with respect to molten metals whose general compositions were 1.4C-4Cr-2W-7Mo-4V-5Co-Fe and 2.2C-4Cr-12W-9Mo-5V-12Co-Fe. The ordinate in FIG. 2 represents the average particle size (−44 μm). As is clear from FIG. 2, a large amount of finer powder can be obtained with the method of the present invention, as compared with the conventional method. This is achieved by the fact that the primary atomizing point ratio was maintained within the proper range.

EXAMPLE 3

Figure 3:
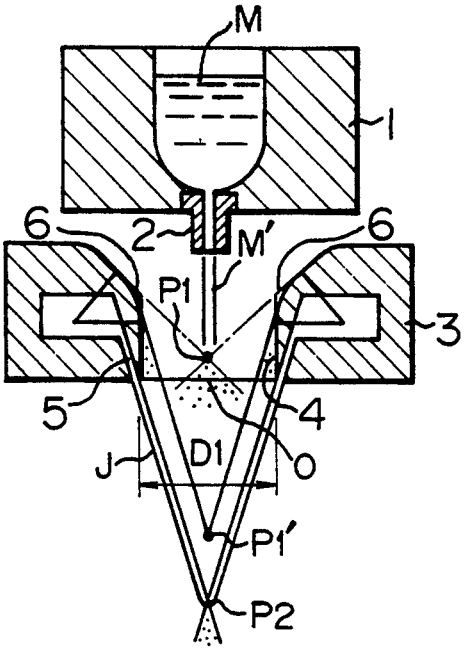
FIG. 3 is a schematic cross-sectional view of a modification of a conventional nozzle used in Example 1.

With respect to the three types of nozzles used in the conventional methods in Example 1, the lower end of the conical surface of each nozzle extending from its upper surface to the injection port was ground to provide an arcuate surface as shown in FIG. 3, and an atomizing test was conducted using the same injection pressures and the same molten metal as in Example 1. Results thereof are shown in Table 2. OP1/OP2 in Table 2 represents the corrected primary atomizing point ratio obtained based on a point P1′ obtained by drawing straight lines relative to the corrected arcuate surface 6 (FIG. 3) in parallel relation to the high-speed jet J.

TABLE 2

| | Intersection angle of jet $\theta_2$ (degree) | Diameter of jet $D_1$ ($\phi$ mm) | $OP_1'/OP_2$* (%) | Injection pressure (MPa) | Atomizing condition | −44 μm average particle size (μm) |
|---|---|---|---|---|---|---|
| Improvement of conventional methods | | | | | | |
| 1′ | 30 | 40 | 67 | 49 | good | 14.7 |
| 2′ | 40 | 38 | 75 | 73.5 | " | 8.1 |
| 3′ | 50 | 38 | 66 | 93.1 | " | 6.2 |

*primary atomizing point ratio

As described above, part of the conical surface extending from the upper surface of the injection nozzle 3 to the injection port, the primary atomizing point ratio is outside the range of 40% to 85%, is made arcuate, and the correction is made so that the primary atomizing point ratio, determined by the point P1′ of intersection between the vertical centerline and the line tangential to this arcuate surface and parallel to the jet J, can be 40% to 85%. The above test indicates that with this correction, the blocking is prevented by the principle of the present invention, and that the average particle size is made fine.

Namely, in the improved method No. 1′ in Table 2, the −44 μm average particle size was 17.8 before the correction, but was made finer on the order of 14.7 μm. The blockage was prevented in each of the improved method Nos. 2′ and 3′, and the −44 μm average particle size of these methods was greatly improved by the above correction. More specifically, the average particle size of the former was changed from 12.8 μm to 8.1 μm, and the average particle size of the latter was changed from 10.5 μm to 6.2 μm.

As described above, in the molten metal-atomizing apparatus of the present invention, the primary atomizing point ratio is limited to 40% to 85%, and, therefore, the formation of the blockage is prevented, and the satisfactory production can be continued, and also the fine powder with a particle size of not more than 10 μm for which there has now been an increasing demand can be efficiently produced.

What is claimed is:

1. A molten metal liquid-atomizing apparatus comprising:

a tundish provided with a molten metal nozzle adapted to cause a molten metal to flow in a downward direction;

an injection nozzle having an inner wall face surrounding the molten metal flow flowing downwardly from the molten metal nozzle, said inner wall face having an upper portion coinciding with a frustoconical part of an imaginary conical surface of an imaginary cone having an apex positioned in the molten metal flow, and an annular injection port located at a lower end of said inner wall face for forming a high speed jet tilted in a downward direction so as to provide an intersection angle in a range of 25° to 50° at a first point positioned in the molten metal flow, said apex and said first point being positioned on a downstream side of the molten metal flow when viewed from a position of the injection port, wherein both a first vertical distance ($OP_1$) defined between the apex and a second point defined by a position at a horizontal level equal to that of a lower end of the injection port, and a second vertical distance ($OP_2$) defined between the first point and the second point are determined such that the first vertical distance is 40%–85% of the second vertical distance.

* * * * *